US009261092B2

(12) United States Patent
Dörfler et al.

(10) Patent No.: US 9,261,092 B2
(45) Date of Patent: Feb. 16, 2016

(54) PUMP, IN PARTICULAR PNEUMATIC PUMP

(71) Applicant: Alfmeier Präzision AG Baugruppen und Systemlösungen, Treuchtlingen (DE)

(72) Inventors: Erich Dörfler, Lansberg am Lech (DE); Ronny Gehlmann, Hilpolstein (DE)

(73) Assignee: Alfmeier Präzision AG Baugruppen und Systemlösungen, Treuchtlingen (DE)

( * ) Notice: Subject to any disclaimer, the term of this patent is extended or adjusted under 35 U.S.C. 154(b) by 0 days.

(21) Appl. No.: 14/097,484

(22) Filed: Dec. 5, 2013

(65) Prior Publication Data

US 2014/0161654 A1 Jun. 12, 2014

Related U.S. Application Data

(63) Continuation of application No. 14/123,998, filed as application No. PCT/EP2012/067126 on Sep. 3, 2012.

(30) Foreign Application Priority Data

Sep. 2, 2011 (DE) ..... 10 2011 082 105

(51) Int. Cl.
*F04B 27/08* (2006.01)
*F04B 49/035* (2006.01)
*F04B 45/04* (2006.01)

(52) U.S. Cl.
CPC ..... *F04B 49/035* (2013.01); *F04B 45/043* (2013.01)

(58) Field of Classification Search
CPC .... F04B 49/22; F04B 43/0045; F04B 43/028; F04B 43/021; F04B 49/24; F04B 49/03
USPC ..... 417/270, 307, 440
See application file for complete search history.

(56) References Cited

U.S. PATENT DOCUMENTS 3,953,154 A * 4/1976 Wanner ..... 417/270
4,049,017 A 9/1977 Jones (Continued)

FOREIGN PATENT DOCUMENTS

CN 200943570 9/2007
CN 101799080 8/2010

(Continued)

OTHER PUBLICATIONS

International Search Report for PCT/EP2012/067126, dated Jan. 16, 2013.

(Continued)

*Primary Examiner* — Charles Freay
(74) *Attorney, Agent, or Firm* — Thomas, Karceski & Karmilovich, P.C.

(57) ABSTRACT

The invention relates to a pump comprising a housing (2), comprising at least one pump chamber (15), comprising an inlet valve (30) that has a valve element (30*a*) which controls an inlet opening (30*c*), comprising an outlet valve (33) that has a valve element (33*a*) which controls an outlet opening (33*c*), comprising a pressure relief valve (43) that has a valve element (43*a*) which controls a pressure relief opening (43*c*) and on which a spring element (48) acts in the closing direction (31), and comprising a spring chamber (49) that receives the spring element. A stop element (51) which can be accessed from the housing outer face and which can be adjusted in the closing direction (31) is arranged in the spring chamber (49), the spring element (48) end that faces away from the closing direction resting against the stop element.

13 Claims, 9 Drawing Sheets

(56) References Cited

U.S. PATENT DOCUMENTS

| | | | | |
|---|---|---|---|---|
| 4,576,554 | A * | 3/1986 | Wagenseil et al. | 417/270 |
| 4,614,481 | A * | 9/1986 | Vanderjagt | 417/270 |
| 5,203,803 | A | 4/1993 | Schoenmeyr | |
| 5,749,709 | A * | 5/1998 | Du | 417/44.8 |
| 5,893,609 | A * | 4/1999 | Schmidt | 297/284.6 |
| 6,135,144 | A * | 10/2000 | Rozek | 137/543.17 |
| 6,206,664 | B1 | 3/2001 | Kakizawa | |
| 8,568,109 | B2 * | 10/2013 | Nathan et al. | 417/270 |
| 2003/0047216 | A1 | 3/2003 | Kelly | |
| 2008/0206078 | A1 * | 8/2008 | Yamamoto et al. | 417/410.4 |

FOREIGN PATENT DOCUMENTS

| | | |
|---|---|---|
| TW | 200508493 | 3/2005 |
| WO | WO 2008/108229 | 9/2008 |

OTHER PUBLICATIONS

Written Opinion for International Search Report for PCT/EP2012/067126 with Machine Translation.
English Abstract for WO2008/108229.
Chinese Office Action dated Jul. 3, 2015 with partial translation.

* cited by examiner

PUMP, IN PARTICULAR PNEUMATIC PUMP

RELATED APPLICATION

This application is a continuation of patent application Ser. No. 14/123,998, filed Dec. 5, 2013, which is a US Nationalization of PCT/EP2012/067126 having a filing date of Sep. 3, 2012, which claims filing benefit of German Patent Application DE102011082105.8 having a filing date of Sep. 2, 2011, which are incorporated herein by reference in their entirety.

TECHNICAL FIELD

The invention refers to a pump, in particular to a pneumatic pump.

BACKGROUND

Pneumatic pumps are used in the automotive sector, for example, for filling the seat bladders with air to change the contour of the seat's sitting and backrest areas. A pump used for the purpose named above, for example, has at least one pump chamber. By enlarging and reducing the chamber volume with the help of a drive unit, surrounding air is suctioned into the pump chamber during volume enlargement and air is driven out from the pump chamber during volume reduction. To control the corresponding air flows, the pump is equipped with an inlet valve that has a valve element for controlling the inlet opening. The inlet valve opens autonomously when the pump chamber enlarges and air flows into it from the surroundings. An outlet valve serves for controlling the outgoing airflow. It is likewise equipped with a valve element, but it controls an outlet opening which opens when air is driven out of the pump chamber.

A pump of the type described above is additionally equipped with a pressure relief valve used especially when a vehicle's seat bladders are being filled because they can leak under an excess pressure load. The pressure relief valve, in turn, has a valve element that closes a pressure relief opening and in closing direction rests on a spring element arranged in a spring space. When the pressure in the pump chamber exceeds a preset value, the excess pressure valve opens when there is a limit pressure set by the spring element. With regard to the respectively permissible maximum pressure of the pneumatic system or of a designed part thereof, the limit pressure can vary depending on the application. So far, the approach has been to use springs of various strengths in the assembly of the pump, but this entails a corresponding logistical and technical assembly effort. Additionally, there is the risk of that the wrong springs could be fit into the pump during assembly.

SUMMARY

The task of the invention is to suggest a pump of the type described above to remedy this situation.

This task is solved according to the present disclosure by arranging a stop element accessible from the external side of the housing and movable in closing direction on which the spring element can rest with its end pointing towards the closing direction. In this way, the required limit pressure can be easily adjusted during assembly by building in a spring element in the spring space that can be universally used for limiting the pressure range. Afterwards, the stop element is brought into the spring space and—while a pressure corresponding to the limit pressure is applied on the pump—is positioned with regard to its distance to the valve element in such a way that the desired limit pressure is reached. When doing so, deviations from limit pressure resulting from manufacturing tolerances can be compensated.

In an especially preferred design variant (particularly advantageous in pump housings made of plastic) it is foreseen for the inner wall of the spring space to have a regulating area extending along the closing direction by holding the excessively dimensioned stop element in a clamped way with regard to the regulating area, whereby the spring space has an actuating opening through which the stop element advancing in closing direction is accessible with a tappet or the like, for example. In this case, the clamping force can be chosen through corresponding dimensional ratios in such a way that the stop element impinged on by the spring element against the closing direction is reliably held in the intended position in the adjustment area. Depending on the chosen excess of the stop element, a more or less elastic and/or plastic deformation of the stop element takes place and/or of a housing wall that circumscribes the spring space. Particularly in the case of housings made of soft materials such as plastic, a stop element made of a material harder than the one used for the pump's housing or for the housing wall that circumscribes the spring space is advantageous. Here, the stop element is pressed into the material of a housing wall that circumscribes the spring space. A metallic stop element is preferably used.

Seen in top view in closing direction, the stop element has a complementary shape to the inner transversal shape of the adjustment area. One result of this is the accomplishment of a sealing of the spring space towards the surroundings and another result is a higher clamping effect. Penetration of humidity into the spring space, for example, is thereby prevented.

Preferably, a stop element executed as a sphere is used, in which case the adjustment area that acts together with the stop element is circularly cylindrical, i.e. forms the surface shell of a circular cylinder. This design rules out a wrong assembly caused by erroneously positioning the stop element in the spring space, for example in a wrong turning position with regard to an axis running parallel to the closing direction.

When pressure relief valves of the type used here open, this is accompanied most of the time by the generation of noise. In at least one design variant independent from the spring space and stop element designs, noise reduction is achieved by having the lower-pressure side of the pressure relief valve end in the spring space. With regard to its surroundings, the spring space can be fully closed so there is no fluid connection to the atmosphere and therefore the propagation of an airborne noise generated inside the spring space is prevented from reaching the exterior. Even if the spring space is connected to the surroundings through a bore hole to allow pressure to equalize between spring space and surroundings—as is the case in a design variant—if excess pressure occurs, this bore hole can have a very small flow cross-section. It is different with the inlet opening, whose flow cross-section cannot be reduced at will so that an airborne noise generated in the pressure relief valve can propagate almost unhindered into the surroundings.

The pressure-equalizing bore hole that connects the spring space to the surroundings mentioned above can be done completely without if the spring space is connected to the inlet opening, in which case its end located upstream (i.e. its entrance opening) does not end directly in the surroundings but in a housing space of the pump in which one drive unit for actuating the pump is arranged. In doing so, the drive unit acts like the insulating material in a sound absorber to eliminate the noise. However, in conventional pumps of the type presented here, the inlet opening is separated by a duct wall of the other housing spaces.

BRIEF DESCRIPTION OF THE DRAWINGS

The invention will now be explained in more detail with the help of the enclosed drawings, which show.

DETAILED DESCRIPTION

Figure 1:
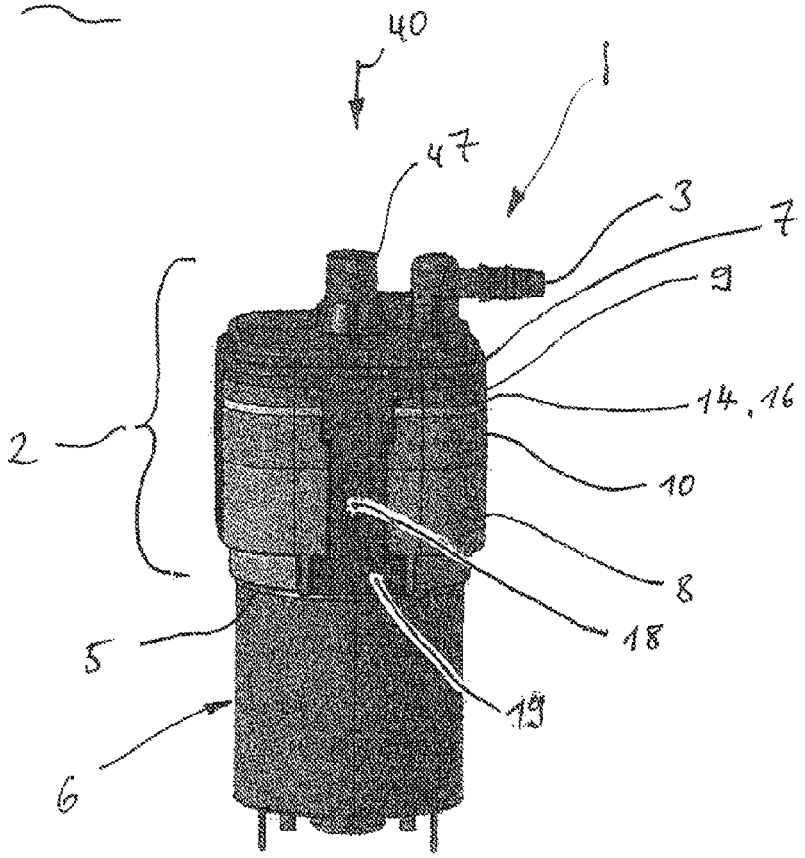
FIG. 1: A perspective lateral view of a pump with a housing encompassing one upper part of the housing, one lower part of the housing, an upper and a lower support, and a motor.
Figure 2:
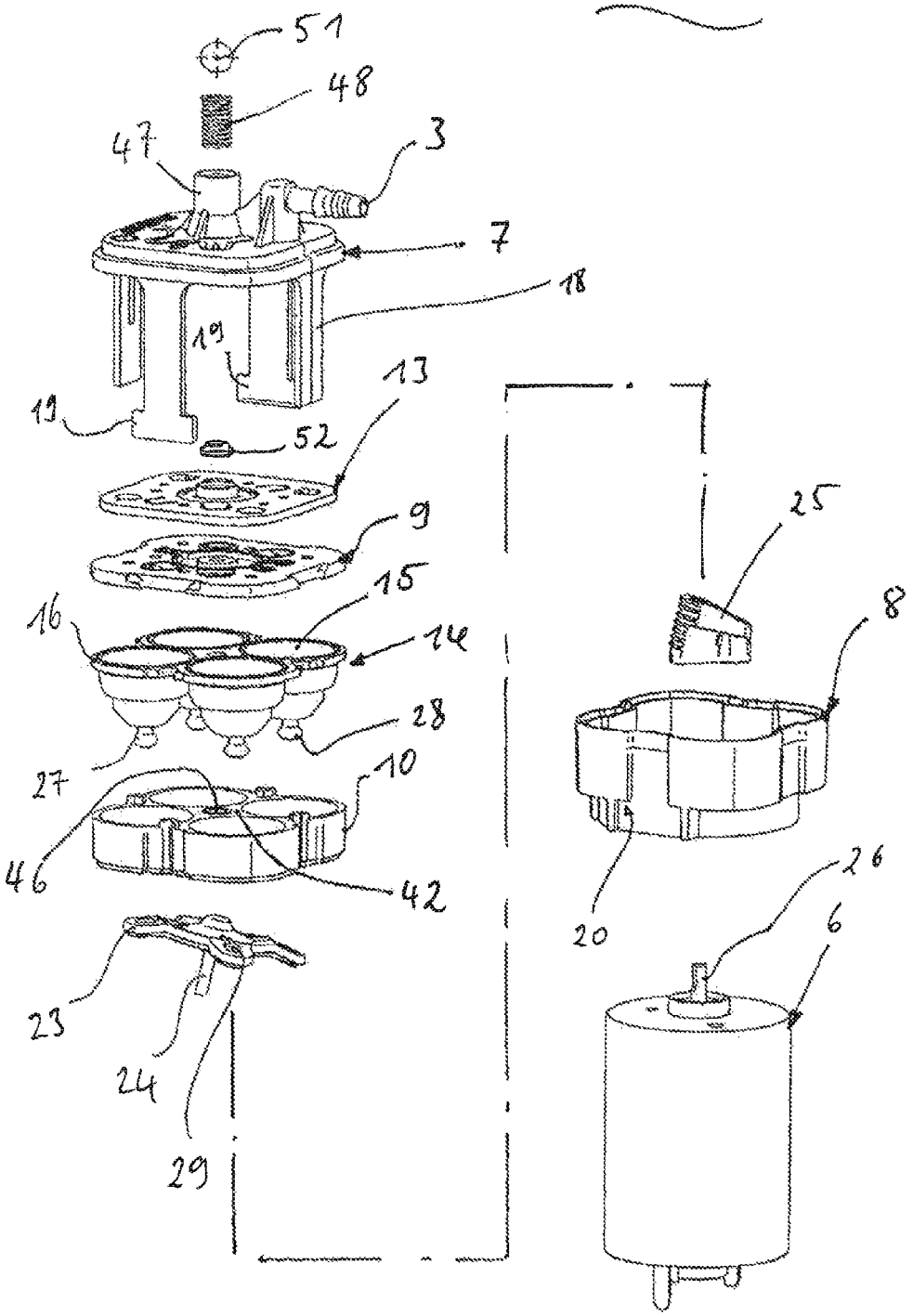
FIG. 2: An exploded view of the pump shown in FIG. 1, FIG. 3: A perspective view of the housing's upper part.

To explain the invention, exemplary reference is made to a pneumatic pump, in which case the designs described also apply to pumps for fluids. The pump 1 shown in the illustrations is intended to be installed in a vehicle seat and serves for filling seat bladders to change the contour of a vehicle seat in the sitting or backrest area, for example. The pump 1 comprises a housing 2 (especially made of plastic) on which an outlet connection piece 3 has been form-fitted. The side of the housing 2 supporting the outlet connection piece 3 will also be referred to as upper side 4 below. A motor 6, especially an electric motor, has been flanged onto the lower side 5 of the housing 2. The housing 2 comprises an upper part 7 and a lower part 8, in which case the upper part 7 supports the connection piece 3 and forms the upper side 4. Two plate-shaped supports—namely an upper support 9 and a lower support 10—are clamped sandwich-like between the upper part 7 and the lower part 8. Between the upper support 9 and the upper part of the housing 7, a plate-shaped valve membrane 13 made of an elastic material (e.g. a rubbery polymer) has been clamped in. Four pot-shaped depressions that create pump chambers 15 have been form-fitted in the pump membrane. In its upper border, the pump membrane 14 has a circumferential bulge 16 clamped between the upper support 9 and the lower support 10. On the upper part of the housing, peripheral arms 18 extending downwards have been form-fitted along the middle longitudinal axis 17 of the pump. On the free end of two diametrically opposing arms 18, a rear grip element 18 has been fixed or form-fitted that, by creating an axially effective positive-locking fit, grips an opposing element 20 on the lower part of the housing 8 from behind. As a result of this, the valve membrane 13, the upper support 9, the pump membrane 14 and the lower support 10 are axially tensed between the upper part of the housing 7 and the lower part of the housing 8. In the lower part of the housing 9, there is a turnstile 23 obliquely positioned with respect to the middle longitudinal axis 17 that has been mounted on an eccentric 25 with an axis 24 protruding from its underside. The eccentric 25, in turn, is connected in a fixed rotary way to a drive shaft 26 of the motor 6. The pump membrane 14 has on the underside, in the area of the pump chambers 15, a tappet-shaped extension 27 with a head-shaped end 28 fixed in a recess 29 of the turnstile.

Figure 3:
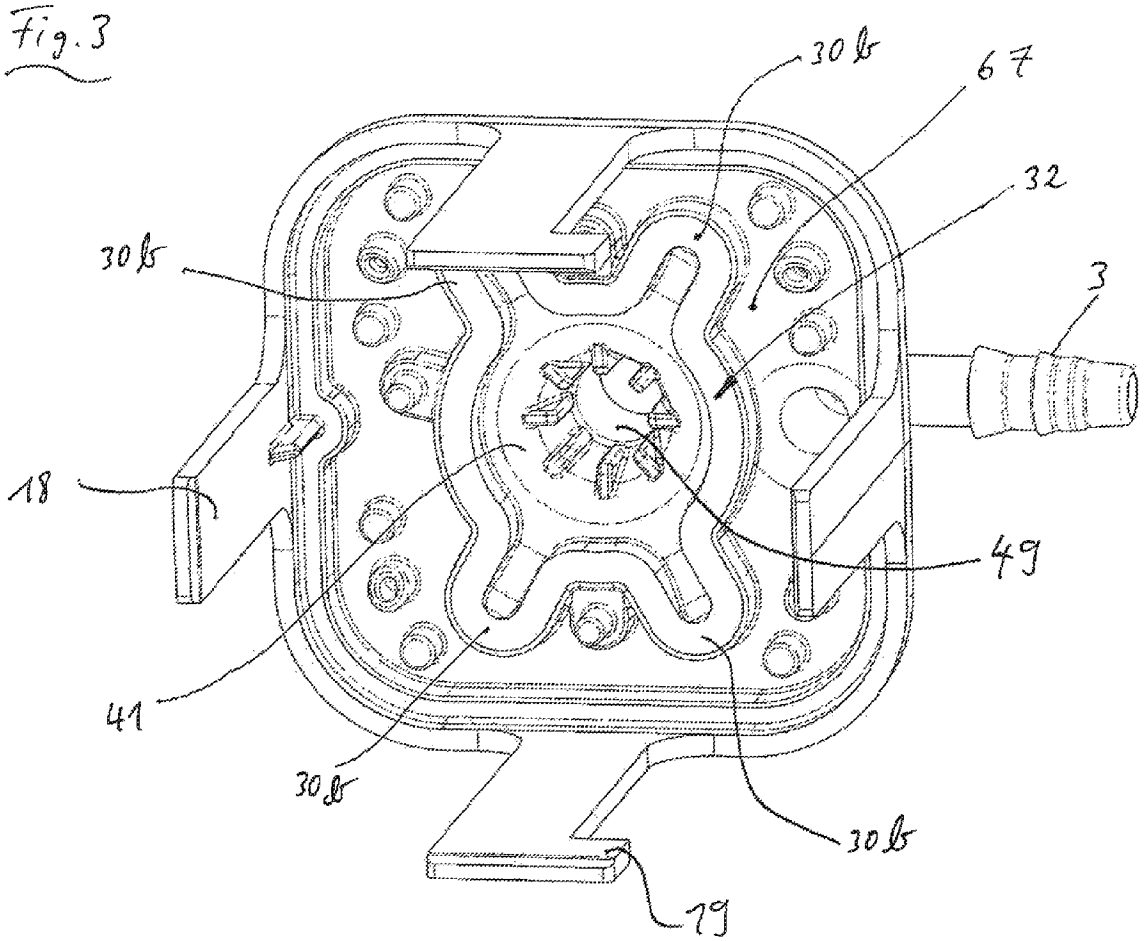
Figure 4:
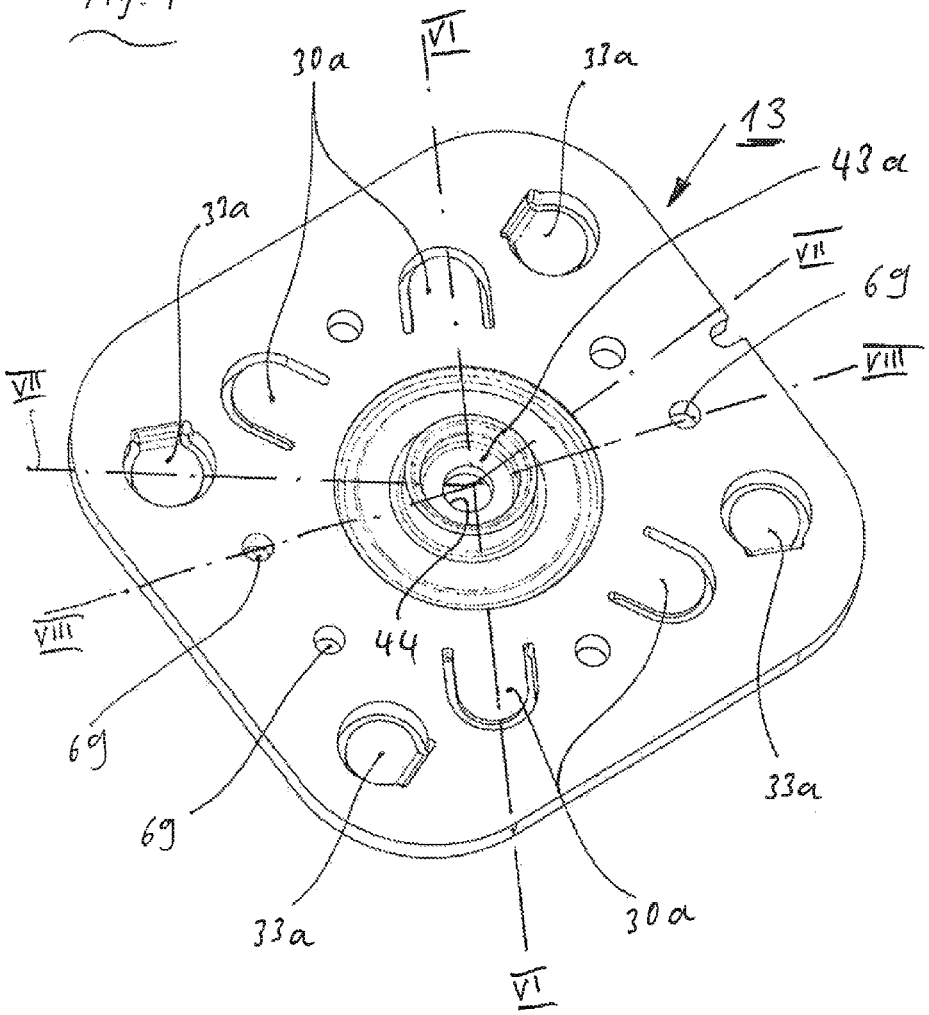
FIG. 4: A perspective view of a valve membrane arranged between the upper part of the housing and the upper support.
Figure 5:
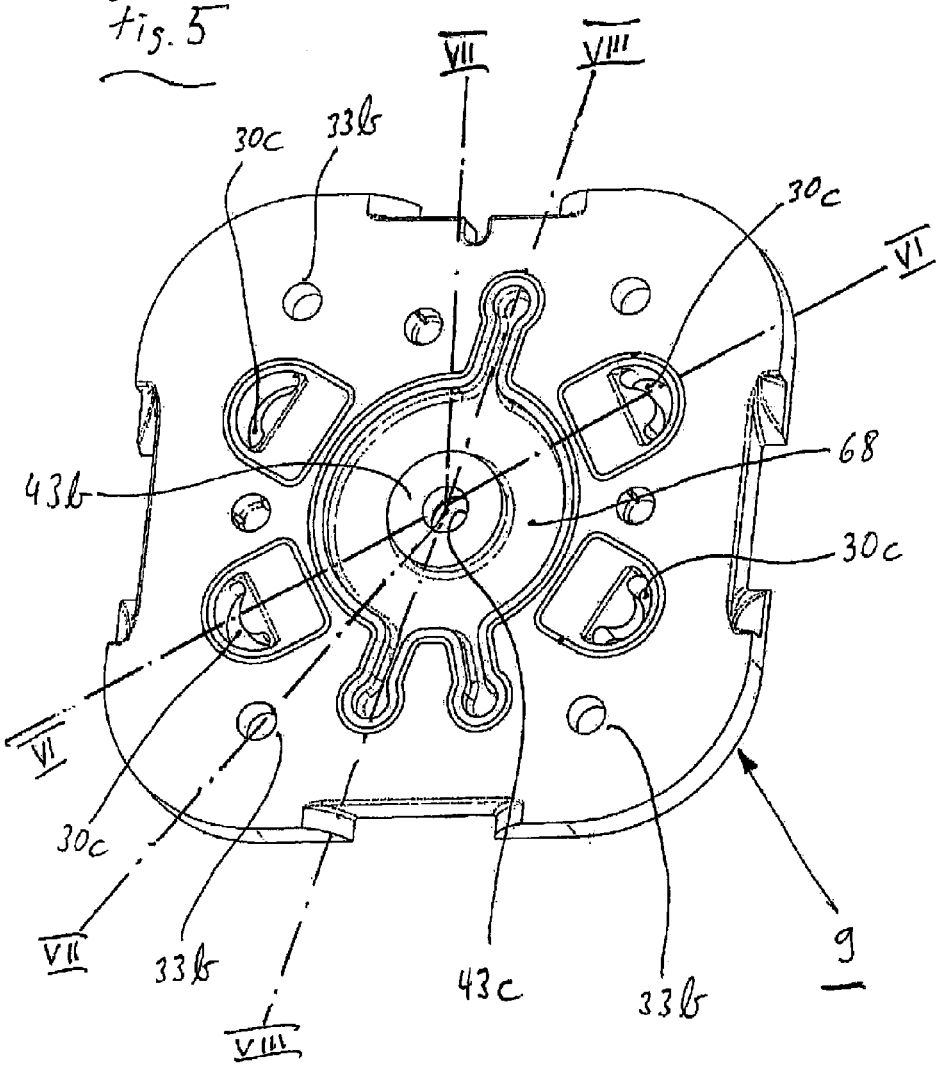
FIG. 5: A perspective view of the upper support.
Figure 6:
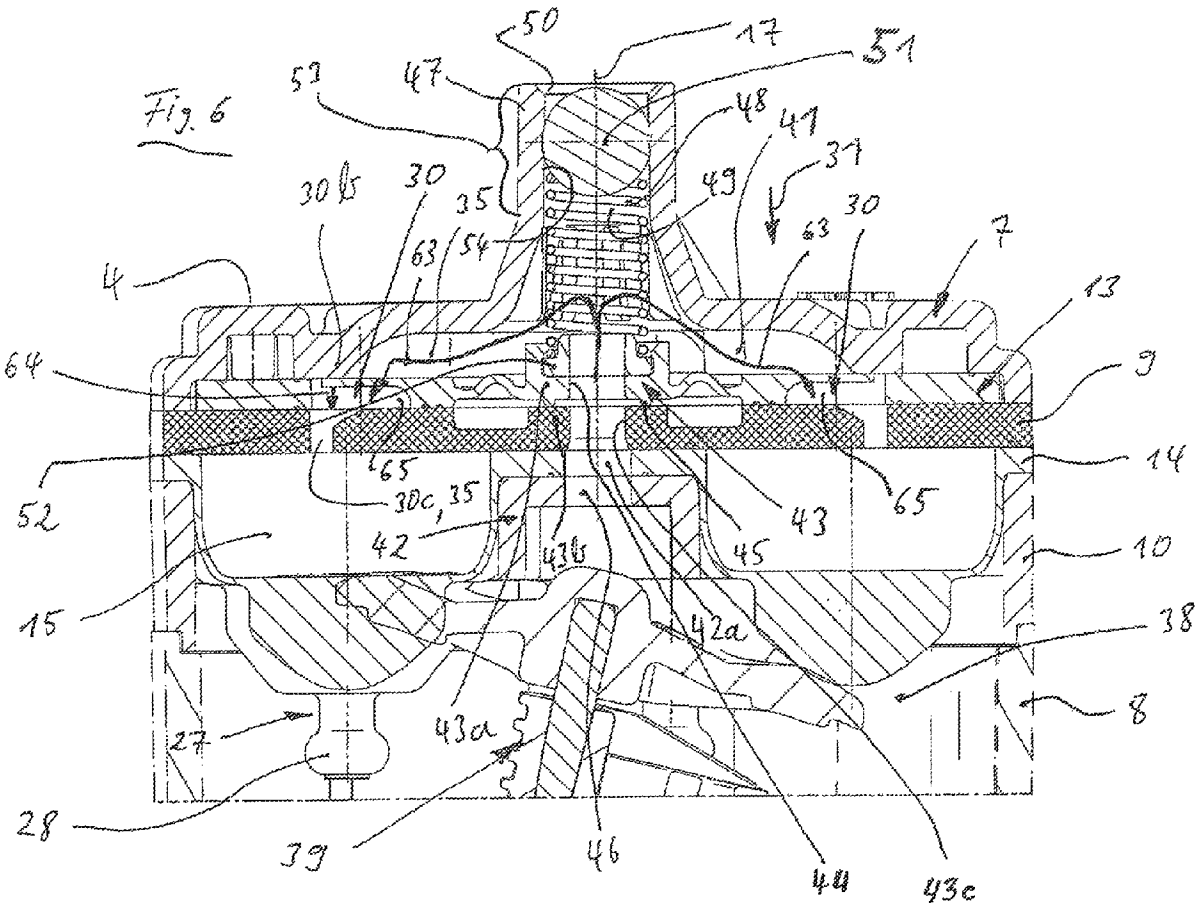
FIG. 6: A longitudinal cut through the pump housing with a cutting line corresponding to line VI-VI in FIGS. 4 & 5, FIG. 7: A longitudinal cut through the pump housing with a cutting line corresponding to line in FIGS. 4 & 5, FIG. 8: A longitudinal cut through the pump housing with a cutting line corresponding to line VIII-VIII in FIGS. 4 & 5, FIG. 9: A partial sectional view of another embodiment of a pump, in which the spring space is connected to the surroundings via a bore hole.
Figure 7:
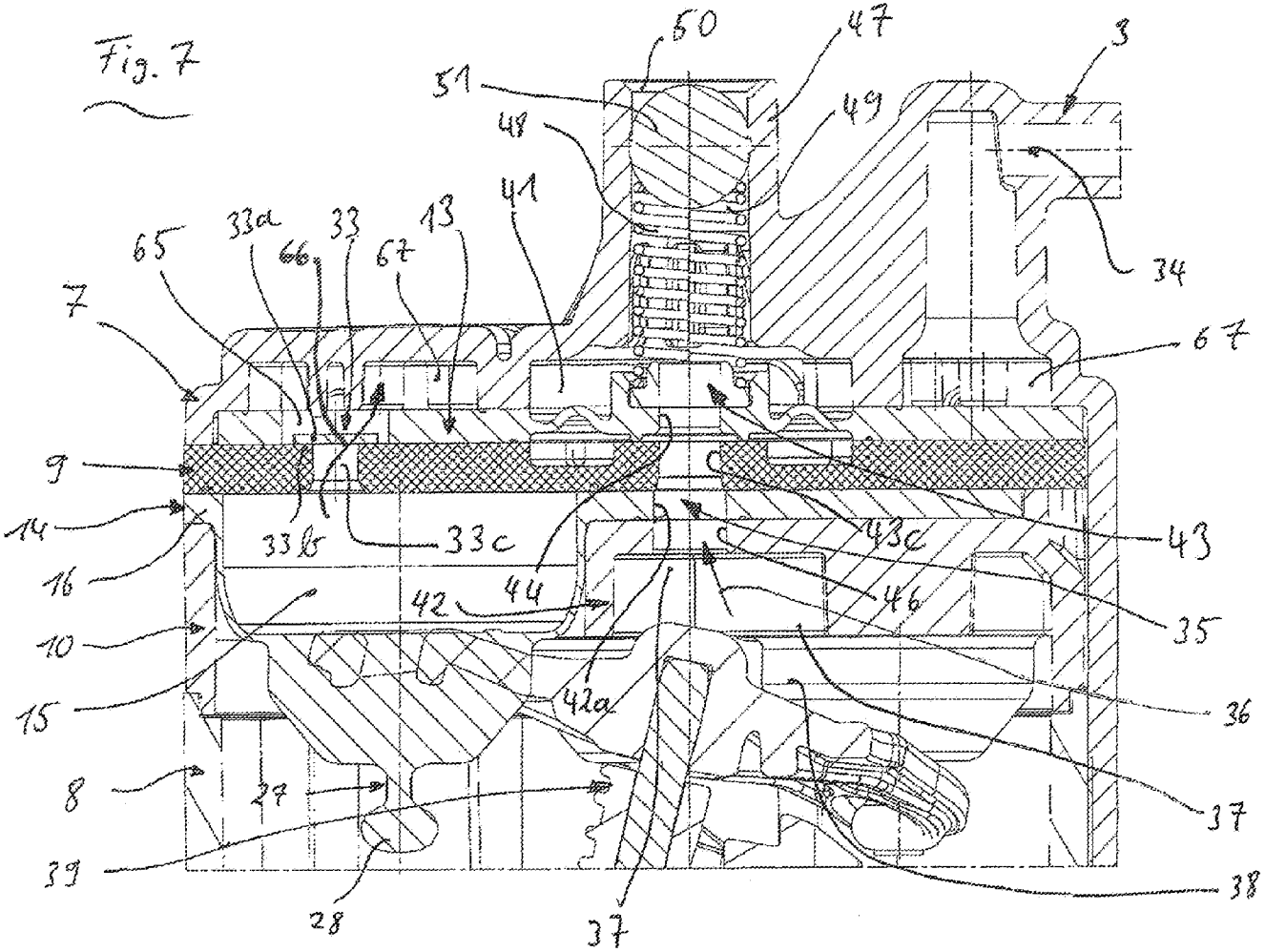

Each pump chamber 15 is assigned to an inlet valve 30 and an outlet valve 33. The outlet valves 33 are arranged in an outlet port 34 that extends inwards from the pump chamber 15 all the way to the inlet connection piece 3 and finally ends in the surroundings (i.e., the environment). The inlet valves 30 are arranged in an inlet port 35 in which—with respect to the inflow direction 36—suctioned air flows towards the pump chamber, the end 37 located upstream ends in a housing space 38, in which a drive unit 39 for actuating the pump chambers 15 (i.e. for enlarging and reducing them), in this case the turnstile 23 and the eccentric 25, are arranged. The inlet valves 30 and the outlet valves 33 have in each case a valve element 30*a* that is freely cut as tongue-shaped parts from a valve membrane 13 forming an entire membrane and that in each case controls an inlet opening 30 and an outlet opening 33*c* located in the upper support 9. Each one of the valve elements 30*a* acts with a seal seat 30*b* protruding from the underside of the upper part of the housing 7 (FIGS. 3 & 6). The seal seats 30*b* are sections of a ring-shaped closed seal seat 32 that separates the lower pressure side of the pump 1 from its pressurized side. The valve seats 33*b* assigned to the outlet valves 33 protrude from the upper side of the upper support 9. In the situation shown in FIG. 7, the valve element 33*a* lies on top of the valve seat 33*b* that encompasses the outlet opening 33*c*.

On the upper side of the valve membrane 13, all inlet ports 35 end in a collecting space 41 (located above the valve membrane 13) arranged centrally on the pump in the direction of the arrow 40 in FIG. 1 in the top view. The collecting space 45 is circumscribed towards the top by the upper part of the housing 7 and towards the bottom by a central area of the valve membrane 13 that comprises the valve elements 30*a* of the inlet valves 30.

Apart from the inlet and outlet vales 30, 33, the pump 1 is equipped with a pressure relief valve 43 developed between a central area of the valve membrane 13 that forms a valve element 43*a* and a seal seat 43*b* of the upper support 9. The valve element 43*b* is centrally arranged in the collecting space 41 and interfused by a central connection opening 44. Thus, the valve element 43*a* is the peripheral area of the valve membrane 13 that circumscribes the connection opening. The valve element 43*a* lies on a ring-shaped seal seat 43*b* of the upper support 9 that circumscribes the pressure relief opening 43*c*. To increase the sealing effect, the peripheral area mentioned above has a sealing lip 45 on its underside. An opening 42*a* interfused with the pump membrane 14 is located centrally in the latter. Below the opening 45, the central area of the pump membrane 14 surrounded by the pump chambers 15 is supported by an area 42 of the lower support 8 that bulges out upwards, in which case it is also interfused with an opening 46. Thus, the section of the inlet port 35 extending away from the valve element 30*a* of the inlet valves 30 against the inflow direction 36 is created by the collecting space, the connection opening 44 and subsequent openings 44, 43*c*, 42*a* and 46, in which case the inlet port 35 ends with the opening 46 in the housing space 38, which is circumscribed by the lower support 10 and the lower part of the housing 8.

A largely cylindrical connection piece 47 open towards the upper side of the housing 4 juts out from a central position of the upper part of the housing 7. The interior of the connection piece creates a spring space 49 for receiving a spring element 48, namely a threaded compression spring. On its front side facing away from the upper part of the housing 7, the connection piece 47 has an assembly opening 50 over which the spring element 48 can be inserted into the spring space 49. The spring element 49 supports itself with its lower end on the valve element 43*a* of the pressure relief valve 43 by means of an intermediate layer of a supporting ring 52, thus impinging on the former in closing direction 31. The other end of the spring element 48, on the other hand, supports itself on a stop element 51 arranged on a fixed axis (with respect to the medium longitudinal axis 17, inside an adjustment area 53 formed by a longitudinal section of the inner wall 54 of the spring space 49). The axially fixed fixation of the stop element 51 is accomplished by making its dimension transversal to the medium longitudinal axis 17 slightly larger than the inside diameter of the adjustment area 53. In the examples shown in the drawings, the inner wall 54 of the adjustment area is cylindrical or extends on the outer surface of a cylinder and has an inside width or diameter 55 that is smaller than the dimension of the stop element 51 in a direction running transversally to the medium longitudinal axis 17. The stop element 51 is preferably a metallic sphere with a diameter 56 slightly larger than the inner diameter 55 of the adjustment area 53. Owing to the dimensions mentioned above and the connection piece's softer plastic material compared to the metallic sphere, the stop element 51 digs itself into the contact area 57 by forming a ring-shaped cavity 58 in the inner wall 54 of the connection piece 47. The dimension relationships mentioned above have been chosen in this case so that the clamping force with which the stop element 51 is held in the adjustment area 53 is larger than the force exerted by the spring element 48 in axial direction. To set a certain limit pressure (i.e. a pump chamber pressure) to which the pressure relief valve 43 should react, the stop element 51 is inserted into the spring space 49 through the assembly opening 50 while the pump is being assembled and moved in closing direction 31 until the spring force exerted by the threaded compression spring 48 correlates with the desired limit pressure.

Figure 9:
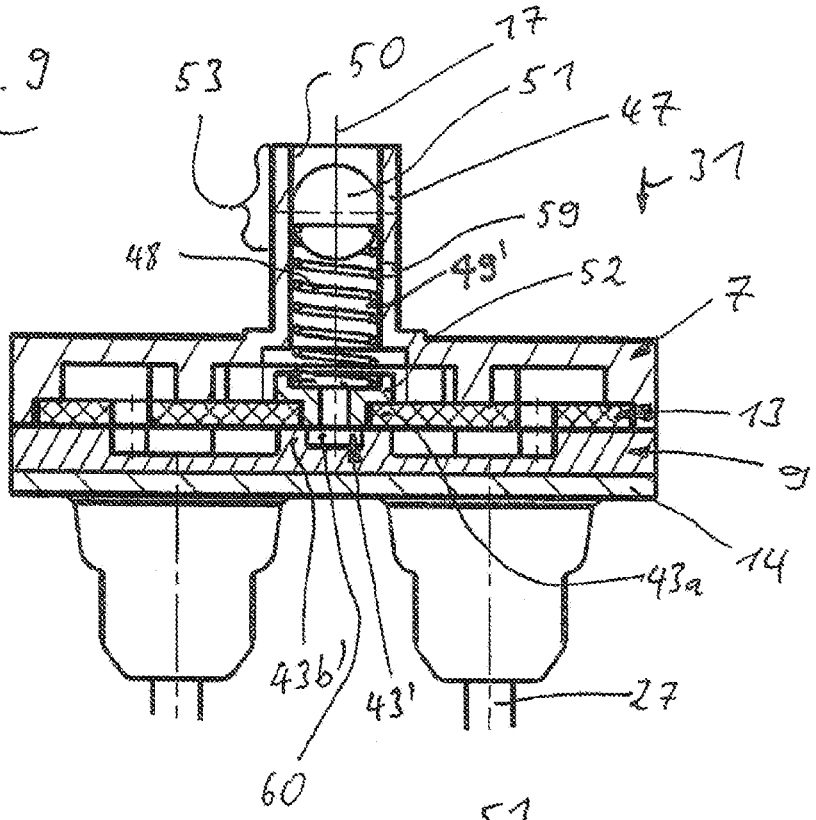
Figure 10:
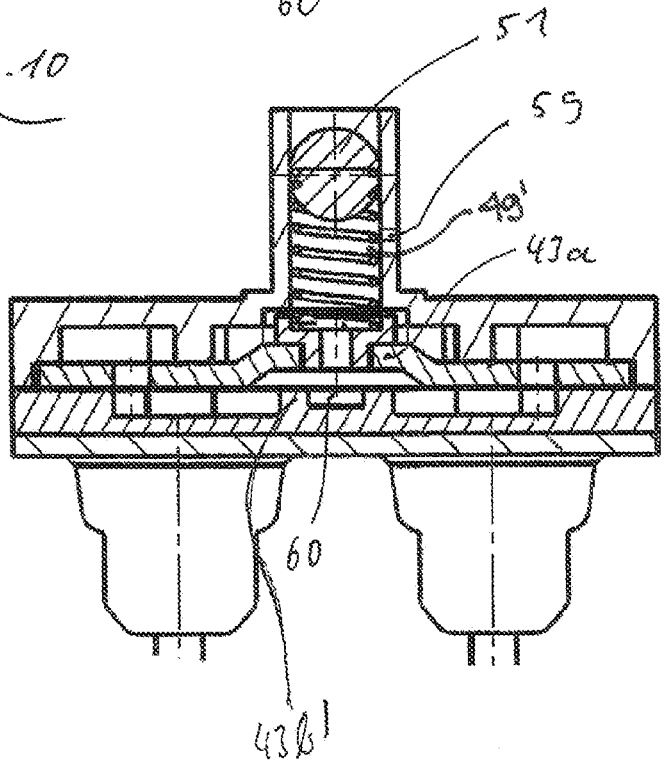
FIG. 10: A sectional view of the pump of FIG. 9, but shown from another angle.

In the design variant shown in FIGS. 9 & 10, the spring space 49' is not connected to an inlet port. Here, the pressure between the spring space and the surroundings is compensated through a connection opening 59 interfused with the wall of the connection piece 47. As in the design variant described above, the valve element 43*a* lies on a ring-shaped seal seat 43*b*', though it does not border an opening but merely a recess 60 dosed towards the bottom. The inlet port (not shown) is therefore not connected to the spring space 49.

The way the pump works will now be explained: When the air from the surroundings or from the housing space 38 is suctioned, it enlarges the pump chambers 15 by moving the extensions 27 of the pump membrane 14 downwards. The air [flows] through the openings 46, 42*a*, 43*c* and 44 into the collecting space 41 (arrows 63) and from there through the inlet valves 30 to the pump chambers 15 (FIG. 6). When this occurs, the valve element 30*a* is elastically deformed and moved downwards (arrow 64) and as this happens, it lifts off the seal seat 30*b*. The valve elements 30*a* and the valve elements 33*a* of the outlet valves 33 are not as thick as the remaining valve membrane 13, so that in each case a free space is created above and below the valve elements that allows the valve elements to be lifted from the respective valve seat.

If the extensions 27 move upwards, the pump chambers 15 are made smaller and air is driven out of them. The air that was driven out flows through the outlet openings 33*c* in accordance with arrow 66 in FIG. 7 and reaches a pressure space (see also FIG. 3) bordered by the valve membrane 13, the upper part of the housing 7 and the seal seat 32. The pressure space is connected to the outlet port 34 of the outlet connection piece 3.

Figure 8:
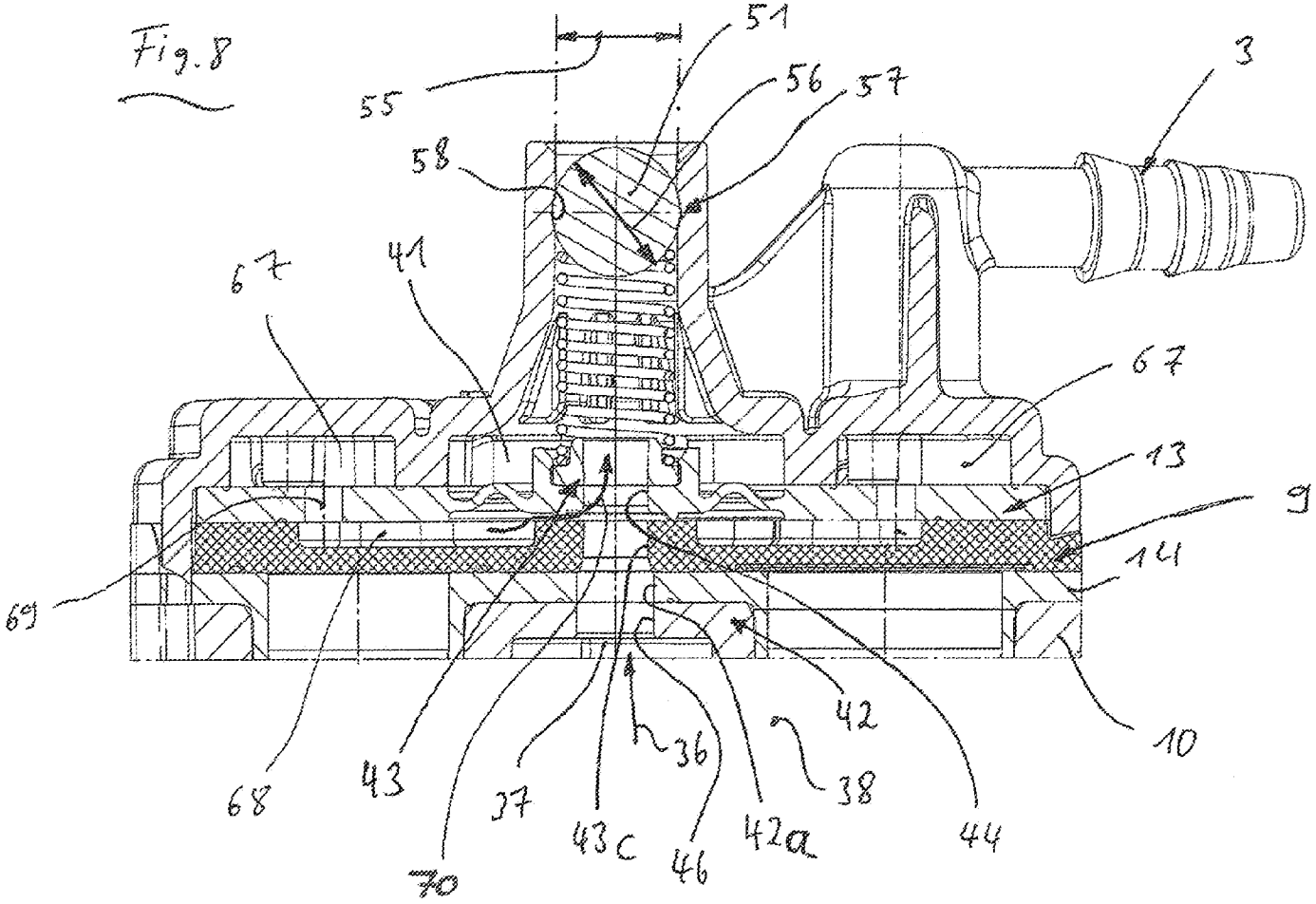

If excess pressure exceeds the limit pressure, the pressure relief valve 43 reacts. When this occurs, the valve element 43*a* is lifted off the valve seat 43*b*, 43*b*', so air can reach the spring space through the connection opening 44 available in the valve element 43*a* (see arrow 70 in FIG. 8). In the design variant shown in FIGS. 9 and 10, pressure is compensated with the surroundings through the connection opening 59, otherwise via the inlet port 35. The impingement of the valve element 43*a* with excess pressure takes place through another pressure space 68 arranged below the valve membrane and bordered by it and the upper support 9. The pressure space 67 mentioned above arranged above the valve membrane is connected to the pressure space 68 arranged below the valve membrane through openings 69.

The invention claimed is:

1. A pump comprising:

a housing, at least one pump chamber, an inlet valve equipped with a valve element that controls an inlet opening, an outlet valve equipped with a valve element that controls an outlet opening, and a pressure relief valve equipped with a valve element impinged on a spring element in a closing direction that controls a pressure relief opening, and with a spring space that contains the spring element whereby a stop element movable in the closing direction and accessible from the outer side of the housing is arranged, on which the spring element supports itself with an end pointing against the closing direction, a lower-pressure side of the pressure relief valve ending in the spring space, the spring space being in fluid connection with an inlet port through a connection opening in the valve element of the pressure relief valve.

2. A pump according to claim 1, wherein the inner wall of the spring space has an adjustment area that extends along the closing direction in which the stop element being dimensioned excessively with regard to the adjustment area is held in place by clamping, whereas the spring space has an actuating opening through which the stop element is accessible for advancing towards the closing direction.

3. A pump according to claim 2, when seen in top view in the closing direction has a complementary shape to the inner cross section shape of the adjustment area.

4. A pump according to claim 2, wherein the stop element is made of a material that is harder than the material of a housing area that circumscribes the spring space.

5. A pump according to claim 4, wherein the housing of the pump is made of plastic.

6. A pump according to claim 4, wherein the stop element is made of metal.

7. A pump according to claim 1, wherein the stop element is a sphere and the inner wall of the adjustment area extends on a circular cylinder surface.

8. A pump according to claim 1, wherein the spring space ends in the environment through a connection opening in a wall circumscribing it the spring space.

9. A pump according to claim 1, wherein a border area circumscribing the connection opening of the valve element is pressed by the spring element against a ring-shaped seal seat that encompasses a pressure relief opening.

10. A pump according to claim 1, wherein an upstream end of the inlet port ends in a housing space of the pump, in which a drive unit that serves to drive the pump is arranged.

11. A pump according to claim 1, wherein the valve elements are part of a one-piece valve membrane clamped between an upper part of the housing and a support supporting them.

12. A pump according to claim 1, wherein the pump has several pump chambers distributed around the pressure relief valve, the pressure relief valve being centrally arranged when seen in a top view in a closing direction.

13. A pump according to claim 1, wherein the at least one pump chamber is made up of a flexible pump membrane.

* * * * *